US008944676B2

(12) United States Patent
Conus et al.

(10) Patent No.: US 8,944,676 B2
(45) Date of Patent: Feb. 3, 2015

(54) ASSEMBLY OF A PART THAT IS BRITTLE

(75) Inventors: Thierry Conus, Lengnau (CH); Marco Verardo, Les Bois (CH); Frédéric Kohler, Villars-sur-Glàne (CH); Igor Saglini, Fenin (CH); Andrés Cabezas Jurin, Yverdon-les-Bains (CH); Jacques Jacot, Fontaines (CH); Maxence Perret-Gentil, Tramelan (CH)

(73) Assignee: ETA SA Manufacture Horlogére Suisse, Grenchen (CH)

( * ) Notice: Subject to any disclaimer, the term of this patent is extended or adjusted under 35 U.S.C. 154(b) by 487 days.

(21) Appl. No.: 13/271,337

(22) Filed: Oct. 12, 2011

(65) Prior Publication Data

US 2012/0090933 A1 Apr. 19, 2012

(30) Foreign Application Priority Data

Oct. 15, 2010 (EP) ..... 10187740

(51) Int. Cl.
*G04B 13/02* (2006.01)
*G04B 15/14* (2006.01)
*G04B 17/32* (2006.01)

(52) U.S. Cl.
CPC ..... *G04B 13/025* (2013.01); *G04B 13/022* (2013.01); *G04B 15/14* (2013.01); *G04B 17/32* (2013.01)
USPC ..... 368/324; 267/182

(58) Field of Classification Search
CPC ..... G04B 13/02; G04B 15/14; G04B 17/32; G04B 1/145; G04B 13/026; F16F 7/12
USPC ..... 267/180–182; 368/322, 324; 29/520
See application file for complete search history.

(56) References Cited

U.S. PATENT DOCUMENTS 7,926,355 B2 * 4/2011 Bannier et al. ..... 73/760
2006/0055097 A1 3/2006 Conus et al.

(Continued)

FOREIGN PATENT DOCUMENTS

EP 1 445 670 A1 8/2004
EP 1 850 193 A1 10/2007

(Continued)

OTHER PUBLICATIONS

European Search Report issued Mar. 24, 2011, in European Application No. 10187740, filed Oct. 15, 2010.

*Primary Examiner* — Christopher Schwartz
(74) *Attorney, Agent, or Firm* — Oblon, Spivak, McClelland, Maier & Neustadt, L.L.P.

(57) ABSTRACT

An assembly including a member made of a first material, which is axially driven into a circular aperture of a part made of a second material that is brittle, using an intermediate part made of a third material and mounted between the member and the part is disclosed. The intermediate part is a continuous cylinder including a hole for receiving the member so that the intermediate part absorbs radially and in a uniform manner, at least part of the axial driving force of the member. The part includes pierced holes forming elastic deformation units distributed around the circular aperture thereof for absorbing any of the radial force not absorbed by the intermediate part, so as to secure the assembly in a non-destructive manner for the part.

20 Claims, 5 Drawing Sheets

(56) References Cited

U.S. PATENT DOCUMENTS

| | | | | |
|---|---|---|---|---|
| 2008/0112274 | A1* | 5/2008 | Bitterli et al. | 368/238 |
| 2010/0238772 | A1 | 9/2010 | Verardo et al. | |
| 2012/0159766 | A1* | 6/2012 | Verardo et al. | 29/520 |
| 2012/0159767 | A1* | 6/2012 | Verardo et al. | 29/520 |
| 2013/0286795 | A1* | 10/2013 | Conus et al. | 368/127 |
| 2013/0309446 | A1* | 11/2013 | Conus et al. | 428/135 |

FOREIGN PATENT DOCUMENTS

| | | |
|---|---|---|
| EP | 2 230 572 A1 | 9/2010 |
| FR | 1 427 115 | 2/1966 |
| JP | 54-141964 | 10/1979 |

* cited by examiner

ASSEMBLY OF A PART THAT IS BRITTLE

This application claims priority from European Patent Application No. 10187740.5 filed Oct. 15, 2010, the entire disclosure of which is incorporated herein by reference.

FIELD OF THE INVENTION

The invention relates to the assembly of a part, made of a material that is brittle, i.e. having no plastic domain, to a member comprising a different type of material.

BACKGROUND OF THE INVENTION

Current assemblies including a silicon-based part are generally secured by bonding. However, bonding is not satisfactory as regards long term hold. Moreover, the operation requires extremely delicate application which makes it expensive.

EP Patent No. 1 850 193 discloses a first, silicon-based part which is assembled on a metal arbour using an intermediate metallic part. However, the shape variants proposed in this document are not satisfactory and either result in the silicon part breaking during assembly, or do not bind the parts sufficiently well to each other.

SUMMARY OF THE INVENTION

It is an object of the present invention to overcome all or part of the aforecited drawbacks by providing an adhesive-free assembly which can secure a part made of a material that is brittle, i.e. with no plastic domain, to a member comprising a ductile material, such as, for example, a metal or metal alloy.

The invention therefore relates to the assembly of a member, made of a first material, in the circular aperture of a part, made of a second material that is brittle, using an intermediate part, made of a third material, mounted between said member and said part, characterized in that the intermediate part is a continuous cylinder comprising a hole for receiving said member, so that the intermediate part absorbs, radially and in a uniform manner, at least part of the axial driving force of said member by elastic and/or plastic deformation, and in that the part includes pierced holes distributed around the circular aperture thereof for absorbing any of said radial force not absorbed by the intermediate part, in order to secure the assembly in a manner that is non-destructive for said part.

This configuration advantageously enables the assembly comprising the part-intermediate part-member to be secured without bonding to an ordinary, precision controlled member, while ensuring that the part is not subject to destructive stresses, even if it is formed, for example, from silicon.

In accordance with other advantageous features of the invention:

- the pierced holes are formed at a distance from and around the circular aperture by two series of diamond-shaped holes distributed in a quincunx arrangement so as to form beams arranged in secant V-shapes;
- the pierced holes include, between the first two series and the circular aperture, a third series which is formed of diamond-shaped holes and arranged in a quincunx arrangement with one of the first two series so as to form beams distributed in secant X-shapes;
- the part includes slots allowing the third series of holes to communicate with the circular aperture;
- the pierced holes are formed at a distance from and around the circular aperture by a first series of oblong holes distributed in a quincunx arrangement with a second series of triangular holes, the second series being the closest to the circular aperture, each triangular hole communicating with the circular aperture via a notch so as to form beams that are radially moveable according to the thickness of the oblong holes;
- the pierced holes include a third series of holes in a triangle, each hole of the third series being distributed between two triangular holes of the second series and communicating with the circular aperture via a slot so as to form beams with two independent arms that are moveable radially according to the thickness of the oblong holes and tangentially according to the thickness of the slots;
- the series of holes extend over a width comprised between 100 μm et 500 μm from the edge of the circular aperture;
- the circular aperture has a diameter of between 0.5 and 2 mm.

Moreover, the invention relates to a timepiece characterized in that it includes an assembly according to any of the preceding variants.

Finally, the invention relates to a method of assembly wherein a member made of a first material is axially driven into a part made of a second material that is brittle, i.e. having no plastic domain. The method includes the following steps:

a) forming the part with a circular aperture and pierced holes distributed around the circular aperture intended to form elastic deformation means;

b) inserting an intermediate, continuous cylindrical part, made of a third material and including a hole, into the circular aperture without any stress:

c) rolling and elastically and/or plastically expanding the intermediate part via the hole therein using said member to exert uniform radial stress against the wall of the part around said circular aperture by relying on said elastic deformation means of the part.

This method advantageously allows the member to be driven in axially without any axial stress being applied to the part. Indeed, advantageously according to the invention, only uniform, radial, elastic deformation is applied to the part. Finally, this method unites the assembly comprising the part—intermediate part—member by adapting to the dispersions in manufacture of the various components.

In accordance with other advantageous features of the invention:

- in step b), the difference between the diameter of the circular aperture and the diameter external section of the intermediate part is approximately 10 μm;
- in step c), the rolling and expansion operation exerts a clamping displacement of between 8 and et 20 μm;
- in steps b) and c), the intermediate part is held in the circular aperture using a shoulder;
- the second material is silicon-based;
- the third material is formed from a metal or metal alloy base;
- the part may be, for example, a timepiece wheel set, timepiece pallets, a timepiece balance spring, a resonator or even a MEMS.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

Figure 1:
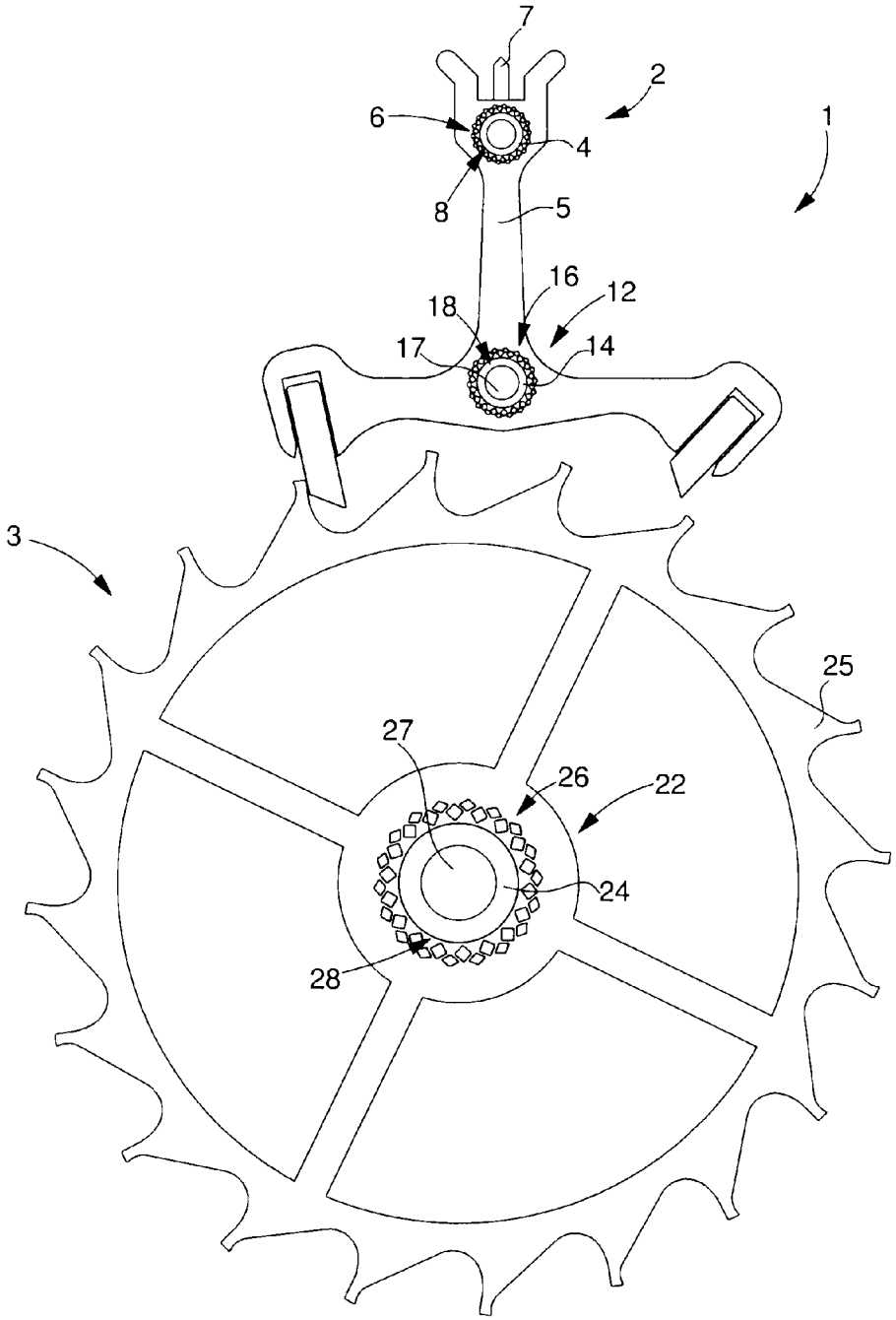
FIG. 1 is a partial schematic view of a timepiece movement including three assemblies according to the invention.

As explained above, the invention relates to an assembly and the method of assembling the same, for securing a fragile material, i.e. which is brittle or has no plastic domain such as a silicon-based material, to a ductile material such as a metal or metal alloy.

This assembly was devised for applications within the field of horology. However, other domains may very well be envisaged, such as, notably, aeronautics, jewellery, the automobile industry or tableware.

In the field of horology, this assembly is required due to the increasing importance of fragile materials, such as those based on silicon, quartz, corundum or more generally ceramics. By way of example, it is possible to envisage forming the balance spring, balance, pallets, bridges or even the wheel sets, such as the escape wheels, completely or partially from a silicon base. However, the fact of always having to use ordinary steel arbours, the fabrication of which has been mastered, is a constraint which is difficult to reconcile with the use of parts that are brittle, i.e. having no plastic domain. Indeed, it is impossible to drive in a steel arbour and this systematically breaks fragile parts, i.e. those which are brittle, with no plastic domain.

This is why the invention relates to an assembly wherein a member made of a first material, for example a ductile material such as steel, is axially driven into the circular aperture in a part made of a second material that is brittle, i.e. having no plastic domain, such as a silicon-based material, by using an intermediate part, made of a third material, more ductile than the first material, which is mounted between said member and said part.

According to the invention, the intermediate part is a continuous cylinder with a hole for receiving said member so that the intermediate part absorbs, radially and in a uniform manner, part of the axial driving force of said member, by elastic and/or plastic deformation. Indeed, when research was carried out, it was clear that the intermediate part had to distribute the radial stresses induced by the rolling and expansion operation over the wall thereof in a uniform manner around the circular aperture.

Consequently, a continuous cylinder, i.e. having no radial slot or axial pierced hole, is required to prevent any localised stresses on part of the wall of the aperture in the fragile part which could break said part.

This interpretation also justifies not using a collar on the top or bottom part of the continuous cylinder. Indeed, during the rolling and expansion operation, this type of collar transmits part of the axial force from the member onto the top (or bottom) of the fragile part. Hence, the shearing exerted, in particular, by the corners of the collar on the top (or bottom) of the fragile part similarly generates localised stresses that can break the fragile part.

Consequently, the continuous cylinder with a hole may be interpreted, if the cylinder section is circular, as a full ring with continuous internal and external walls, i.e. without any grooves or more generally any discontinuity of material. The continuous cylinder therefore only generates uniform radial stress by elastic and/or plastic deformation on the wall around the circular aperture, without any requirement to observe a particular axial direction for driving in the member.

Moreover, the part includes pierced holes forming elastic deformation means which are distributed around and at a distance from the circular aperture therein and which are for absorbing any said radial forces not absorbed by the intermediate part so as to secure the assembly in a manner that is non-destructive for said part. The elastic deformation of the fragile part due to the pierced holes thus secures said fragile part to the assembly comprising the intermediate part—member secured by the plastic deformation of the continuous cylinder.

The assembly according to the invention will be better understood with reference to FIGS. 1 to 8 showing example applications within the field of horology. FIG. 1 shows a timepiece escape system, including pallets 1 and an escape wheel 3.

Pallets 1, by way of example, include two assemblies 2, 12 according to the invention, respectively for securing the dart 7 and pivot pin 17 to the lever 5. As seen in FIG. 1, each assembly 2, 12 includes an intermediate part 4, 14, in the form of a full ring, cooperating between dart 7 or pivot pin 17 and lever 5 of pallets 1. Moreover, each assembly 2, 12 includes pierced holes 6, 16 made in lever 5 around a circular aperture 8, 18 and which are intended to form elastic deformation means. It is thus clear that assembly 2, 12 is sufficiently resistant to avoid generating relative movements between its components.

Figure 2:
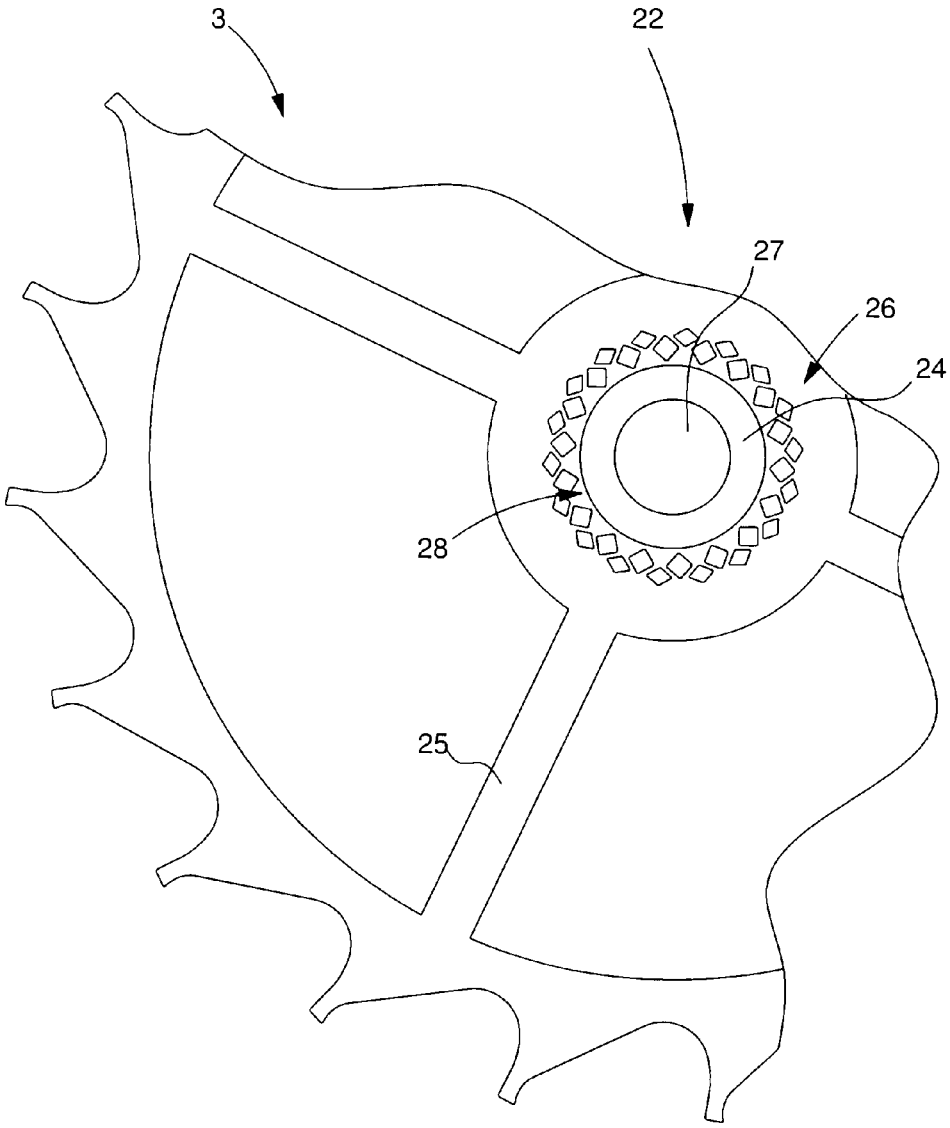
FIG. 2 is a partial enlarged view of FIG. 1.

The escape wheel 3, and more generally wheel set 3 includes, by way of example, an assembly 22 respectively for securing pivot pin 27 to body 25 of wheel 3. As seen in FIGS. 1 and 2, assembly 22 includes an intermediate part 24 in the form of a full ring cooperating between pivot pin 27 and body 25 of wheel 3. Moreover, assembly 22 includes pierced holes 26, which are made in the hub around a circular aperture 28 in wheel 3 and intended to form elastic deformation means.

It is thus immediately clear that the example assembly 22 can be applied to any type of wheel set. Further, pivot 27 may comprise a pinion in a single piece so as to form the finished wheel set.

Examples of pierced holes are shown in FIGS. 3 to 8. According to a first embodiment illustrated in FIGS. 3 to 6, the pierced holes are formed at a distance from and around the circular aperture by two series of diamond-shaped holes distributed in a quincunx arrangement so as to form beams arranged in secant V-shapes.

Figure 3:
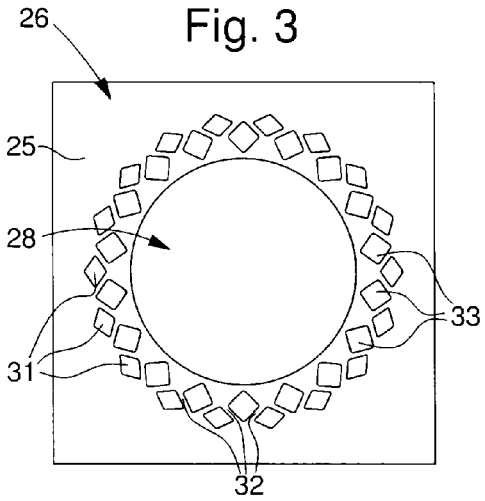
FIGS. 3 to 6 are views of variants of a first embodiment of elastic deformation means according to the invention.

FIG. 3 is a diagram of pierced holes 6, 16, 26 of FIGS. 1 and 2. For more simplicity, only the wheel 3 references are used again in FIG. 3. FIG. 3 shows pierced holes 26, which preferably pass through the entire thickness of body 25, made of fragile material. Pierced holes 26 are distributed at a distance from and around circular aperture 28 which is also preferably formed to pass through the entire thickness of body 25 made of fragile material.

As seen in FIG. 3, pierced holes 26 form a first series of holes 31, the farthest from aperture 28, and a second series of holes 33, which are diamond-shaped and in a quincunx arrangement. FIG. 3 shows that pierced holes 31, 33 thus form V-shaped beams 32 which are secant to each other.

Figure 4:
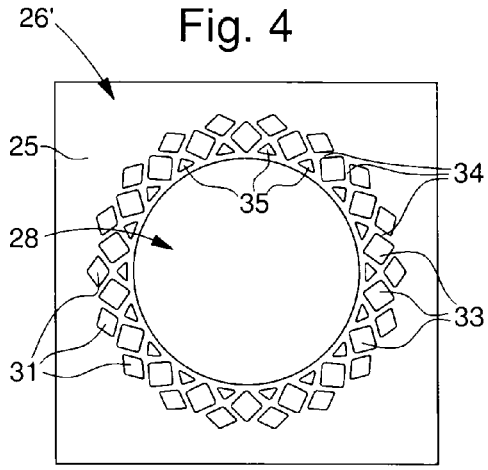

In a first variant of the first embodiment illustrated in FIG. 4, pierced holes 26' again comprise the first and second series of holes 31, 33 with the addition of a third series, which, formed of diamond-shaped holes 35, is located between the first two series and circular aperture 28, i.e. the closest to aperture 28. As seen in FIG. 4, the third series of holes 35 is distributed in a quincunx arrangement with one 33 of the first two series to form X-shaped secant beams 34.

Figure 5:
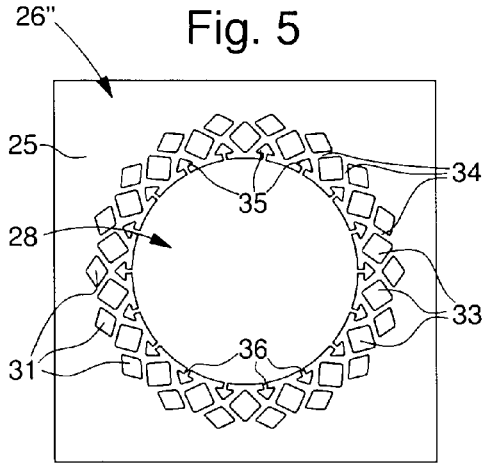

In a second variant of the first embodiment illustrated in FIG. 5, the pierced holes 26" again comprise the pierced holes 26' of FIG. 4 with the addition of slots 36 via which the third series of holes 35 communicate with circular aperture 28.

Advantageously according to the invention, holes 31, 33 and 35 and slots 36 are used to form elastic deformation means capable of absorbing radial stresses, i.e. forces exerted from the centre of circular aperture 28 towards the wall of body 25 surrounding said circular aperture.

Of course, the two or three series may be closer to or further from each other and/or of different shapes and/or different dimensions according to the maximum desired clearance and the desired stress for deforming beams 32, 34.

Figure 6:
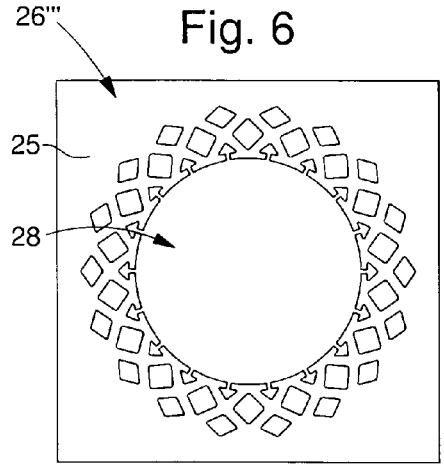

By way of example, an alternative to FIG. 5 is shown in FIG. 6. It can be seen that pierced holes 26''' are similar to those 26" of FIG. 5. However, the three series of holes are spaced further apart from each other. Further, it can be seen that the shapes and dimensions of both the holes and slots are different. It is thus clear that the alternative of FIG. 6 alters the rigidity of the elastic deformation means in the silicon.

Preferably, pierced holes 26, 26', 26", 26''' extend over a width comprised between 100 μm et 500 μm from the edge of circular aperture 28. Further, slots 36 are comprised between 15 μm et 40 μm. Finally, the diameter of circular aperture 28 is preferably comprised between 0.5 and 2 mm.

Figure 7:
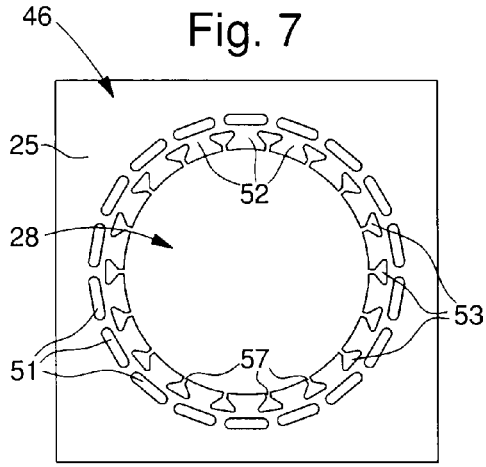
FIGS. 7 and 8 are views of variants of a second embodiment of elastic deformation means according to the invention.
Figure 8:
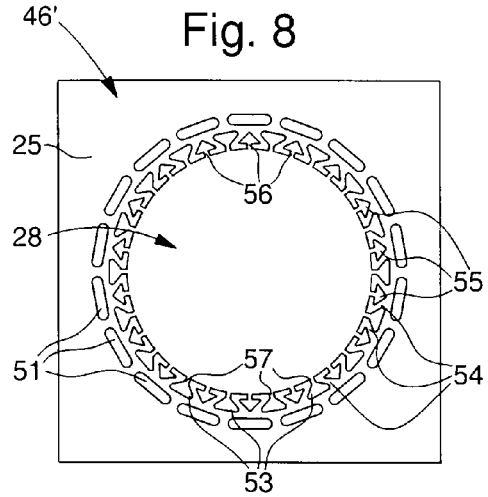

According to a second embodiment illustrated in FIGS. 7 and 8, the pierced holes are formed at a distance from and around the circular aperture by a first series of oblong holes distributed in a quincunx arrangement with a second series of triangular holes, the second series being closest to the circular aperture, each triangular hole communicating with the circular aperture via a notch so as to form beams that are radially moveable according to the thickness of the oblong holes.

Thus, FIG. 7 shows pierced holes 46 which preferably pass through the entire thickness of body 25, made of fragile material. Pierced holes 46 are distributed at a distance from and around circular aperture 28 which is also preferably formed to pass through the entire thickness of body 25 made of fragile material.

As seen in FIG. 7, pierced holes 46 form a first series of oblong holes 51 and a second series of triangular holes 53. According to the second embodiment, the two series of holes 51, 53 are arranged in a quincunx arrangement.

Further, each triangular hole 53 communicates with circular aperture 28 via a notch 57. FIG. 7 shows that pierced holes 46 thus form trapezium shaped beams 52 which are separated from each other by notches 57. It is also noted that each beam 52 is centred on an oblong hole 51, which makes each beam 52 radially moveable according to the thickness of an oblong hole 51.

In a variant of the second embodiment illustrated in FIG. 8, pierced holes 46' again comprise the pierced holes 46 of FIG. 7, with the addition of a third series of triangular holes 55. Further, each hole 55 of the third series is arranged between two triangular holes 53 of the second series and communicates with circular aperture 28 via a slot 56. The pierced holes 46' thus form beams 54 with two independent symmetrical and substantially L-shaped arms, which are radially moveable according to the thickness of hole 51 and tangentially moveable according to the thickness of slots 56.

Of course, as in the first embodiment, the two or three series may be closer to or further from each other and/or of different shapes and/or of different dimensions according to the maximum desired clearance and the desired stress for deforming beams 52, 54.

Preferably, pierced holes 46, 46' extend over a width comprised between 100 μm et 500 μm from the edge of circular aperture 28. Further, slots 56 or notches 57 are comprised between 15 μm et 40 μm. Finally, the diameter of circular aperture 28 is preferably comprised between 0.5 and 2 mm.

Figure 9:
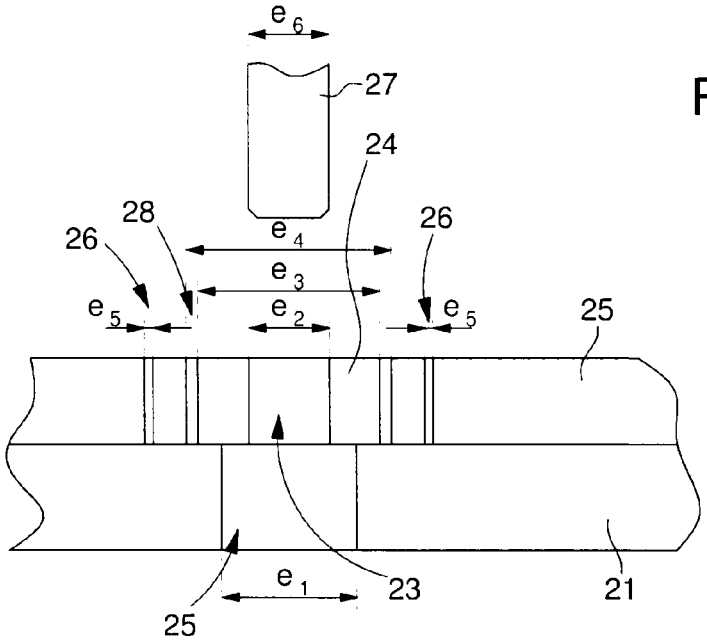
FIGS. 9 to 11 are schematic diagrams of successive steps of the assembly method according to the invention.

The method of assembly will now be explained with reference to the schematic FIGS. 9 to 11. For more simplicity, only the wheel 3 references are used again in FIGS. 9 to 11. According to the invention, a first step consists in forming part 3 from a material that is brittle, i.e. having no plastic domain with a circular aperture 28 and pierced holes 26, which are distributed around circular aperture 28 and intended to form elastic deformation means, in accordance, for example, with the embodiments explained hereinbefore. As seen in FIG. 9, circular aperture 28 has a diameter $e_4$ and pierced holes 26 include holes of section $e_5$.

This step may be achieved by dry or wet etching, for example a DRI etching.

Further, in a second step, the method consists in forming pivot pin 27 in a second material with a maximum section $e_6$. As explained hereinbefore, the second step can be carried out in accordance with ordinary arbour fabrication processes. Pivot pin 27 is preferably metal and may for example be formed of steel.

In a third step, the method consists in forming intermediate continuous cylindrical part 24 in a third material with a hole 23 of internal section $e_2$ and external section $e_3$. The third step can thus be achieved by conventional machining or electroforming. Intermediate part 24 may thus have a thickness of between 100 et 300 μm and a width l, i.e. the external section $e_3$ minus the internal section $e_2$ ($l=e_3-e_2$), also comprised between 100 et 300 μm.

Preferably, the third material is more ductile than the second material of pin 27 so that the latter is not deformed during the rolling and expansion operation. Intermediate part 24 is preferably metal and may thus include nickel and/or gold. However, any other ductile material may advantageously be added to the third material or replace the latter.

Of course, the first three steps do not have to observe any particular consecutiveness and may even be performed at the same time.

In a fourth step, intermediate part 24 is inserted into circular aperture 28 without any contact. This means, as seen in FIG. 9, that the diameter $e_4$ of circular aperture 28 is larger than or equal to the external section $e_3$ of intermediate part 24.

Preferably, the difference between diameter $e_4$ of circular aperture 28 and external diameter $e_3$ of intermediate part 24 is approximately 10 μm, i.e. a thickness of around 5 μm, which separates body 25 of part 3 relative to intermediate part 24.

Further, preferably, according to the invention, intermediate part 24 is held in circular aperture 28 using a shoulder 21 provided with a bore of section $e_1$.

Finally, the method includes a fifth step consisting in rolling and elastically and/or plastically expanding intermediate part 24 via the hole 23 thereof by fitting pin 27 in axial direction A so as to exert a uniform radial stress B against the wall of circular aperture 28 by relying on the elastic deformation means of part 3, i.e. pierced holes 26.

Figure 10:
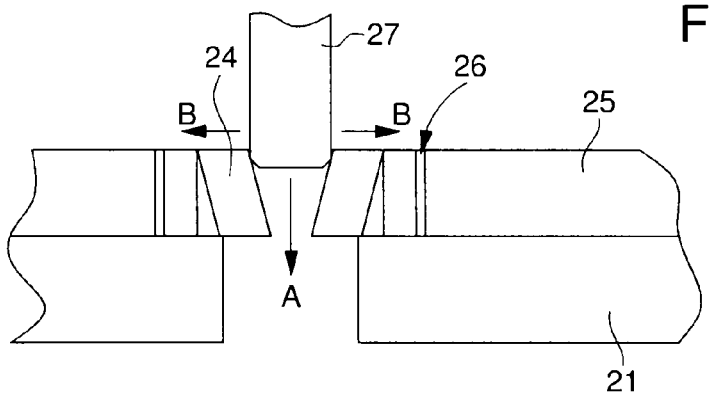

Thus, first of all, as seen in FIG. 10, because section $e_6$ of pin 27 is larger than section $e_2$ of the intermediate part, when pin 27 passes (shown schematically) into hole 23 in direction A, this will cause an elastic and/or plastic deformation of intermediate part 24, which is deformed exclusively in the radial direction B by abutting against shoulder 21.

Preferably according to the invention, the rolling and expansion operation is set so that the clamping force is greater at the gap between the non-deformed intermediate part 24 and the wall of part 3 around circular aperture 28. Preferably, the clamping force is arranged to provide a displacement comprised between 8 and 20 μm.

Figure 11:
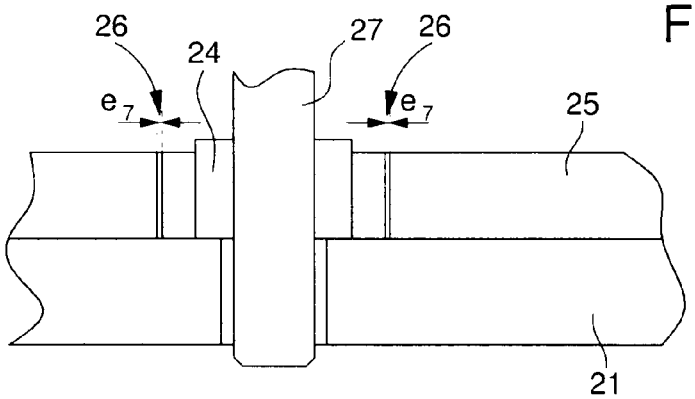

Consequently, after the elastic and/or plastic deformation of intermediate part 24 in the first phase, it is desirable for the rolling and expansion operation to exert, in a second phase, elastic deformation of body 25 around circular aperture 28 so as to unite the assembly comprising pin 27, intermediate part 24 and wheel 3, as shown in FIG. 11. This elastic deformation automatically centres the assembly comprising pin 27—intermediate part 24. In this regard, FIG. 11 shows that the pierced holes 26 have a section referenced $e_7$ and no longer $e_5$.

Advantageously according to the invention, it is possible to drive in pin 27 from any side of body 25 of wheel 3. Further, no axial force is applied to body 25 of wheel 3 during the process. Only radial elastic deformation is applied. It is also to be noted that the use of continuous cylinder intermediate part 24 allows uniform stress to be exerted on the wall of body 25 around circular aperture 28 during radial deformation B of intermediate part 24, in order to prevent breaking the fragile material of wheel 3 and to adapt to any dispersions in fabrication of the various components.

Of course, this invention is not limited to the illustrated example but is capable of various variants and alterations that will appear to those skilled in the art. In particular, the pierced holes of the part made of fragile material may include more or fewer series of holes than the embodiments presented hereinbefore.

FIGS. 1 and 2 show applications for an escape system, such as the pallets 1 and escape wheel 3 of a timepiece movement. Of course, the present assembly 2, 12, 22 may be applied to other elements. By way of example, it is possible to envisage forming a balance spring, a balance, a bridge or more generally a wheel set using an assembly 2, 12, 22 as explained hereinbefore.

Figure 12:
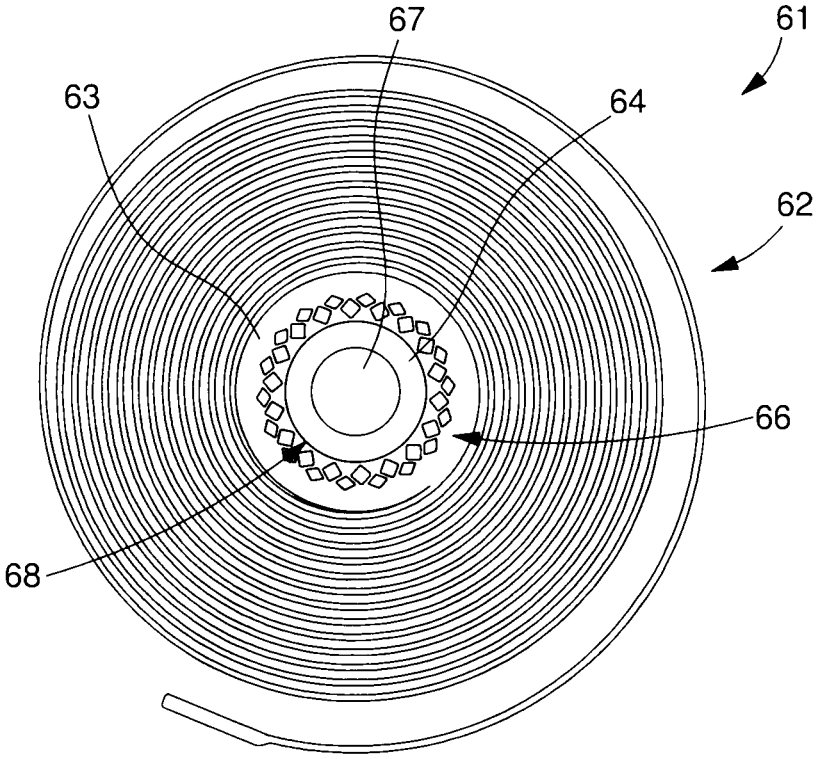
FIG. 12 is a partial schematic view of a timepiece balance spring including an assembly according to the invention.

Thus, as illustrated in FIG. 12, it is possible to fix a balance spring 61 to an arbour 67 using an assembly 62 according to the invention. Pierced holes 66 could then be formed in the collet 63 of balance spring 61 and an intermediate part 64 could be mounted in aperture 68 of collet 63 in a similar way to that set out hereinbefore.

It is also possible to use assembly 2, 12, 22, 62 in place of elastic means 48 or the cylinders 63, 66 of WO Patent No. 2009/115463 (which is incorporated herein by reference) so as to fix a single-piece sprung balance resonator to a pivot pin.

Finally, assembly 2, 12, 22, 62 according to the invention can also unite any type of timepiece or other member, whose body is formed of a material that is brittle, i.e. having no plastic domain (silicon, quartz, etc.) with an arbour, such as, for example, a tuning fork resonator or more generally a MEMS (Microelectromechanical system).

Of course, two members like those described hereinbefore may also be secured to the same arbour using two distinct assemblies 2, 12, 22, 62 so as to unite their respective movements.

What is claimed is:

1. An assembly of a member made of a first material in a circular aperture of a part made of a second material that is brittle, using an intermediate part made of a third material mounted between the member and the part made of the second material, wherein the intermediate part is a continuous cylinder comprising a hole for receiving the member, so that the intermediate part absorbs, radially and in a uniform manner, at least part of an axial driving force of the member by at least one of elastic and plastic deformation, and wherein the part made of the second material includes pierced holes forming elastic deformation means distributed around the circular aperture thereof for absorbing any of the radial force not absorbed by the intermediate part, in order to secure the assembly in a manner that is non-destructive for the part made of the second material.

2. The assembly according to claim 1, wherein the pierced holes are formed at a distance from and around the circular aperture by two series of diamond-shaped holes distributed in a quincunx arrangement so as to form beams arranged in secant V-shapes.

3. The assembly according to claim 2, wherein the pierced holes include, between the first two series and the circular aperture, a third series which is formed of diamond-shaped holes and arranged in a quincunx arrangement with one of the first two series so as to form beams distributed in secant X-shapes.

4. The assembly according to claim 3, wherein the part has slots allowing the third series of holes to communicate with the circular aperture.

5. The assembly according to claim 1, wherein the pierced holes are formed at a distance from and around the circular aperture by a first series of oblong holes distributed in a quincunx arrangement with a second series of triangular holes, the second series being the closest to the circular aperture, each triangular hole communicating with the circular aperture via a notch so as to form beams that are radially moveable according to the thickness of the oblong holes.

6. The assembly according to claim 5, wherein the pierced holes include a third series of triangular holes, each hole of the third series being arranged between two triangular holes of the second series and communicating with the circular aperture via a slot so as to form beams with two independent arms that are moveable radially according to the thickness of the oblong holes and tangentially according to the thickness of the slots.

7. The assembly according to claim 1, wherein the series of holes extend over a width comprised between 100 μm and 500 μm from the edge of the circular aperture.

8. The assembly according to claim 1, wherein the diameter of the circular aperture is comprised between 0.5 and 2 mm.

9. A timepiece including at least one assembly according to claim 1.

10. A method of assembling the assembly of claim 1 wherein the member made of the first material is axially driven into the part made of the second material that is brittle, including the following steps:

a) forming the part with the circular aperture and pierced holes distributed around the circular aperture to form the elastic deformation means;

b) inserting the intermediate, continuous cylindrical part, made of the third material and including the hole, into the circular aperture;

c) rolling and elastically and/or plastically expanding the intermediate part via the hole therein using the member to exert uniform radial stress against a wall of the part around the circular aperture by using the elastic deformation means of the part made of the second material.

11. The assembly method according to claim 10, wherein, in step b), the difference between the diameter of the circular aperture and the external section of the intermediate part is approximately 10 μm.

12. The assembly method according to claim 10, wherein, in step c), the rolling and expansion operation exerts a clamping displacement comprised between 8 and 20 μm.

13. The assembly method according to claim 10, wherein, in steps b) and c), the intermediate part is held in the circular aperture by using a shoulder.

14. The assembly according to claim 1, wherein the second material is silicon-based.

15. The assembly according to claim 1, wherein the third material is a metal or metal alloy base.

16. The assembly according to claim 1, wherein the part made of the second material is a timepiece wheel.

17. The assembly according to claim 1, wherein the part made of the second material includes timepiece pallets.

18. The assembly according to claim 1, wherein the part made of the second material is a timepiece balance spring.

19. The assembly according to claim 1, wherein the part made of the second material is a resonator.

20. The assembly according to claim 1, wherein the part made of the second material is a MEMS.

* * * * *